US006888054B2

(12) United States Patent
Minakuchi

(10) Patent No.: US 6,888,054 B2
(45) Date of Patent: May 3, 2005

(54) BODY STRUCTURE OF GUITAR

(75) Inventor: Kiyoshi Minakuchi, Hamamatsu (JP)

(73) Assignee: Yamaha Corporation (JP)

( * ) Notice: Subject to any disclaimer, the term of this patent is extended or adjusted under 35 U.S.C. 154(b) by 44 days.

(21) Appl. No.: 10/437,190

(22) Filed: May 14, 2003

(65) Prior Publication Data

US 2003/0213356 A1 Nov. 20, 2003

(30) Foreign Application Priority Data

May 16, 2002 (JP) ..... 2002-141163

(51) Int. Cl.[7] ..... G10D 3/00
(52) U.S. Cl. ..... 84/291; 84/293; 84/267
(58) Field of Search ..... 84/291, 293, 267

(56) References Cited

U.S. PATENT DOCUMENTS 3,915,049 A 10/1975 Bean
4,126,073 A * 11/1978 Takabayashi ..... 84/293
4,295,403 A * 10/1981 Harris ..... 84/293
4,896,578 A 1/1990 Marx
5,347,904 A * 9/1994 Lawrence ..... 84/291

FOREIGN PATENT DOCUMENTS

JP 55-2460 1/1980
JP 55-36872 8/1980

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A body structure of an electric guitar of a solid type is constituted by a body and a neck, which are firmly joined together using adhesive and/or bolts. An engagement hollow is formed over the entire length of the back of the body, and an extending portion is integrally extended from a base portion of the neck with a smoothly curved portion therebetween. The base portion of the neck is engaged with a rectangular hollow formed in the front end portion of the body, and the extending portion of the neck is engaged with the engagement hollow of the back of the body. An adhesive bank channel is formed in the periphery of the bottom of the engagement hollow to prevent an excess of adhesive from overflowing and dirtying the backs of the body and neck when joined together using adhesive.

7 Claims, 8 Drawing Sheets

BODY STRUCTURE OF GUITAR

BACKGROUND OF THE INVENTION

1. Field of the Invention

This invention relates to body structures of electric guitars constituted by solid bodies, necks, and heads, which convert vibrations of strings into electric signals, thus producing sounds via speakers.

2. Description of the Related Art

In general, electric guitars have been classified into two types according to body structure, namely, a solid type and a semi-acoustic type. Electric guitars of the solid type are each produced using one sheet of wood, which is processed and formed in a prescribed shape suited to a solid body that is complete solid inside or in which a hollow space is formed by routing and the like. Electric guitars of the semi-acoustic type (as disclosed in Japanese Examined Utility-Model Publication No. Sho 55-2460) are each produced using a prescribed wood such as a Japanese (or Yeddo) spruce or other spruce, which is processed into an exterior board and a side board to form an acoustic-guitar-like body that acts as a hollow resonating body. This invention relates in particular to an electric guitar having a completely solid body.

FIG. 9 shows a conventional example of an electric guitar of a solid type, wherein an electric guitar 1 has a body structure constituted by a solid body 2 and a neck 3, six steel strings 4, a bridge 5, pickups 6 for converting vibrations of strings 4 into electric signals, a tailpiece 7, various controls (e.g., dials or wheels) 8 for controlling a tone volume, a tone color, etc., and tuning pegs 9. Both the solid body 2 and the neck 3 are normally made of a prescribed solid wood material (whose thickness ranges from 40 mm to 50 mm, for example), which is processed and formed in prescribed shapes and is then subjected to painting and polishing. Herein, the solid body 2 and the neck 3 are integrally joined together using adhesive, bolts, and the like. Reference numeral 10 designates a joining portion between the solid body 2 and the neck 3.

FIG. 10 shows an example of a conventional body structure of an electric guitar that is disclosed in Japanese Examined Utility-Model Publication No. Sho 55-36872, wherein an elongated hollow (or channel) 12 is formed over the entire length of a body 2 approximately at the center of the surface thereof, and a neck base 13 is integrally elongated from a base portion 3A of a neck 3. Herein, the neck base 13 is sandwiched between a pair of elongated boards 14*a* and 14*b*, and it is firmly engaged with the elongated hollow 12 of the body 2 by using adhesive, bolts, and the like.

The aforementioned body structure of an electric guitar shown in FIG. 10 is characterized in that the neck base 13 integrally elongated from the base portion 3A of the neck 3 is engaged with the elongated hollow 12 of the body 2 with a relatively large contact area, which in turn guarantees a relatively high joining strength compared with the body structure of an electric guitar shown in FIG. 9. Herein, the neck base 13 is firmly engaged with the elongated hollow 12 of the body 2 by intervention of the elongated boards 14*a* and 14*b* made of hardwood. Therefore, it is possible to efficiently and effectively transmit vibrations of strings (not shown), which are transmitted to the neck base 13 via a bridge 5, to the body 2 via the elongated boards 14*a* and 14*b*. Thus, it is possible to reduce a transmission loss of vibration.

In the body structure of an electric guitar shown in FIG. 10, the elongated hollow 12 is formed on the surface of the body 2; therefore, it is necessary for a worker or a craftsman to produce the body 2 and the neck 3 with a very careful attitude in processing, polishing, and painting, for example. Specifically, it is necessary to process and form the elongated hollow 12, neck base 13, and elongated boards 14*a* and 14*b* with a very high precision so as not to cause differences and gaps when the neck base 13 is fitted to the elongated hollow 12 of the body 2.

In a process of joining the body 2 and the neck 3 using adhesive, when a relatively great amount of adhesive is used, an excess of adhesive may overflow from the elongated hollow 12 of the body 2 to dirty exterior surfaces of the body 2 and the neck 3, whereas when a relatively small amount of adhesive is used, a joining strength may be reduced. Therefore, it is necessary to pay great attention to the amount of adhesive used for joining the body 2 and the neck 3 together.

Generally, each of conventional electric guitars may have a "rectangular" body structure because the back and sides of the base portion 3A of the neck 3 are formed to cross each other with approximately right angles therebetween. Therefore, when a player (or a user) holds the base portion 3A of the neck 3, the player may feel a pain in a hand directly brought into contact with rectangular (or square) corners. This causes difficulty for a player playing an electric guitar at a so-called "high position" on the neck 3.

SUMMARY OF THE INVENTION

It is an object of the invention to provide a body structure of an electric guitar in which an exterior surface of a body can be processed and finished without difficulties, and a relatively great joining strength can be realized between a body and a neck, which are smoothly joined together to contribute to an improvement in a user's (or player's) ability of playing, particularly at a high position. In a joining process using adhesive, it is possible to reliably prevent adhesive from unnecessarily dirtying exteriors of the body and neck of an electric guitar.

A body structure of this invention adapted to an electric guitar of a solid type is constituted by a body and a neck, which are firmly joined together using adhesive and/or bolts. An engagement hollow (or channel) is formed over the entire length of the back of the body at approximately the center area thereof, and an extending portion is integrally extended from a base portion of the neck with a smoothly curved portion (namely, an S-curved face) therebetween. Then, the base portion of the neck is engaged with a rectangular hollow formed in the front end portion of the body, and the extending portion of the neck is engaged with the engagement hollow of the back of the body. In order to cope with a process of joining together the body and neck using adhesive, an adhesive bank channel is formed in the periphery of the bottom of the engagement hollow formed on the back of the body. Hence, it is possible to reliably prevent an excess of adhesive from dirtying the backs of the body and neck when joined together using adhesive. In addition, the body and neck can be firmly joined together because of a relatively great contact area formed between the engagement hollow of the body and the extending portion of the neck. Furthermore, a joining process is performed particularly on the backs of the body and neck, which does not require finishing on the exterior surface of the body; thus, it is possible to simplify manufacture of an electric guitar.

Due to the provision of the S-curved face to smoothly and continuously connect together backs of the base portion and rod of the neck, it is possible to improve performability in playing an electric guitar at a high position, in which a player (or a user) holds the neck in proximity to the base portion. In addition, no angular portions or corners are formed on the base portion and rod of the neck, so that the player does not feel a pain in holding the neck during playing of an electric guitar. This may contribute to a further improvement in a player's ability of playing an electric guitar particularly at the high position.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
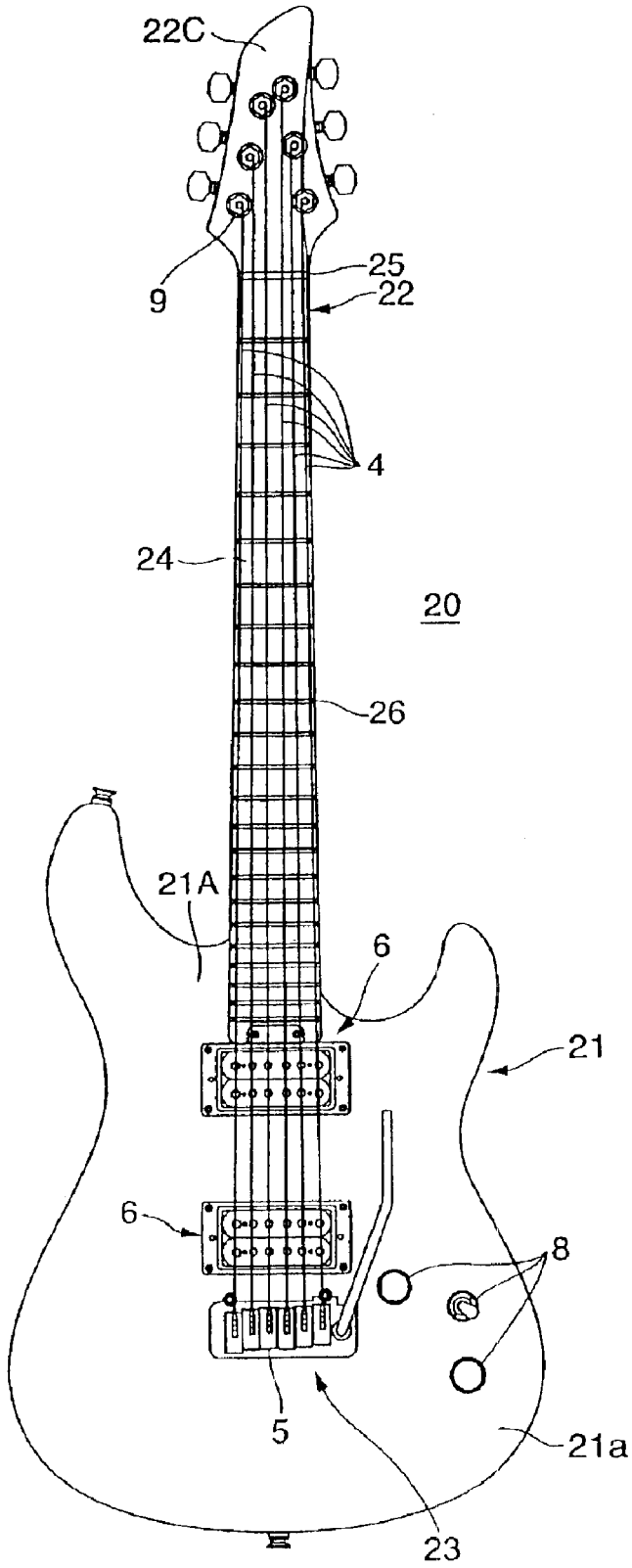
FIG. 1 is a plan view showing an exterior appearance of an electric guitar having a body structure in accordance with a preferred embodiment of the invention.
Figure 2:
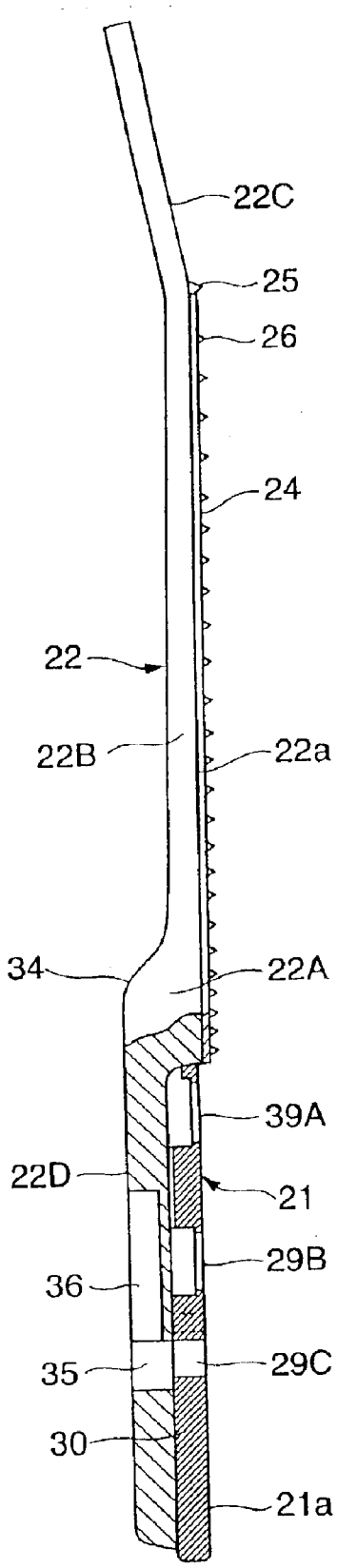
FIG. 2 is a side view partly in cross section showing the body structure of the electric guitar of FIG. 1.
Figure 3:
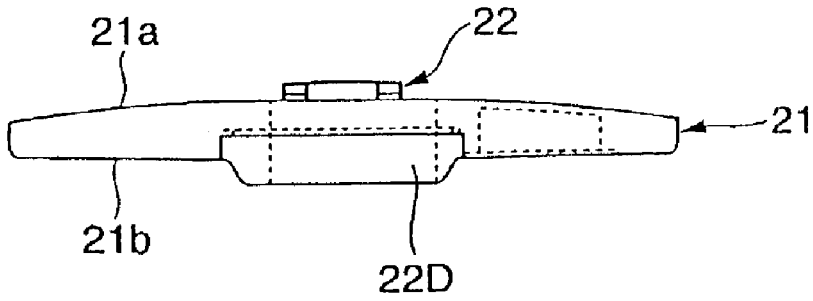
FIG. 3 is a bottom view showing a body of the electric guitar of FIG. 1.
Figure 4:
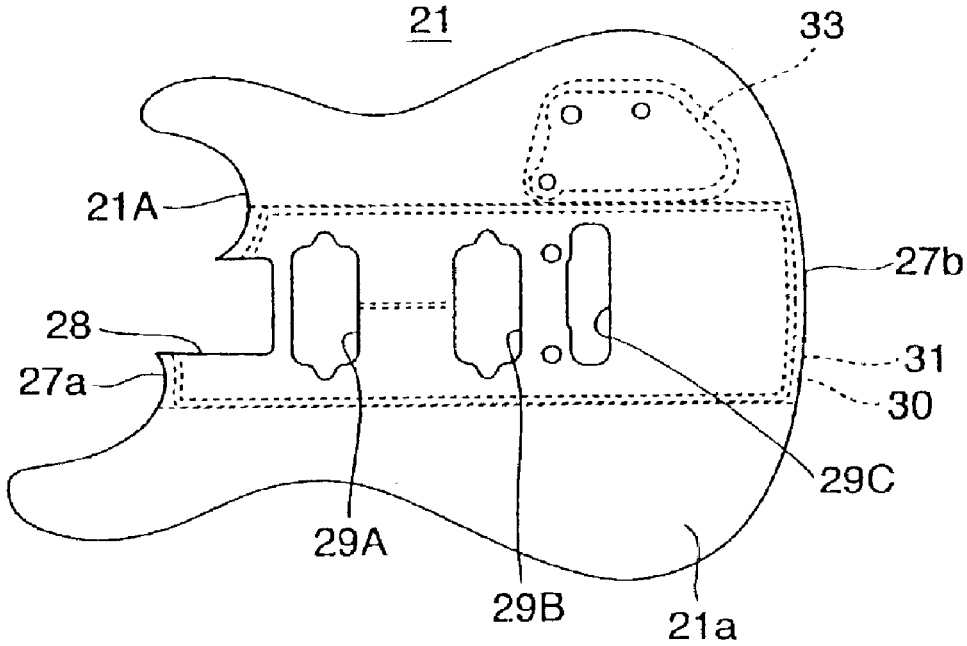
FIG. 4 is a plan view of the body.
Figure 5:
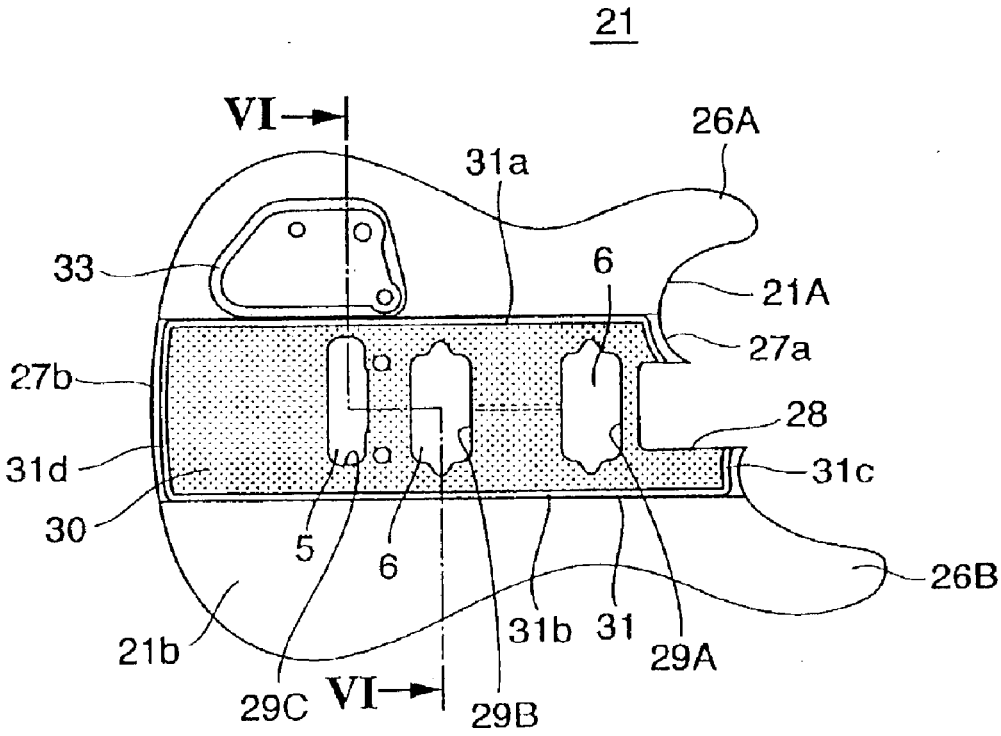
FIG. 5 is a back view of the body.
Figure 6:
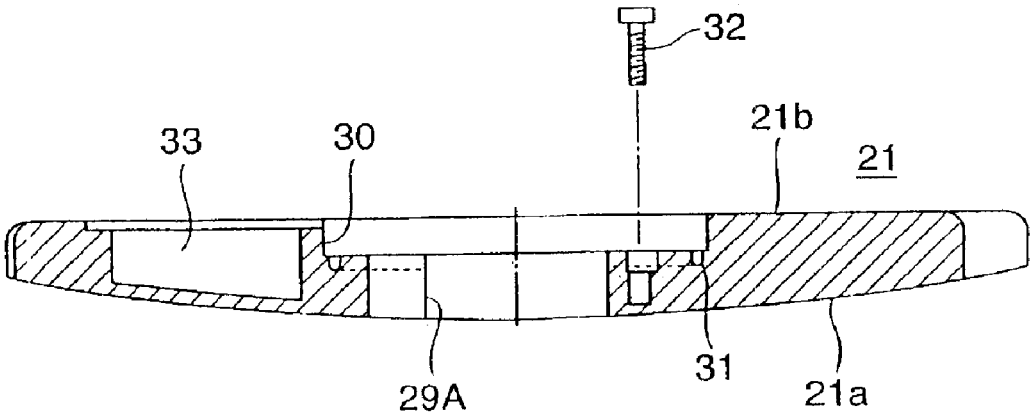
FIG. 6 is an enlarged cross sectional view taken along line VI—VI in FIG. 5.
Figure 7:
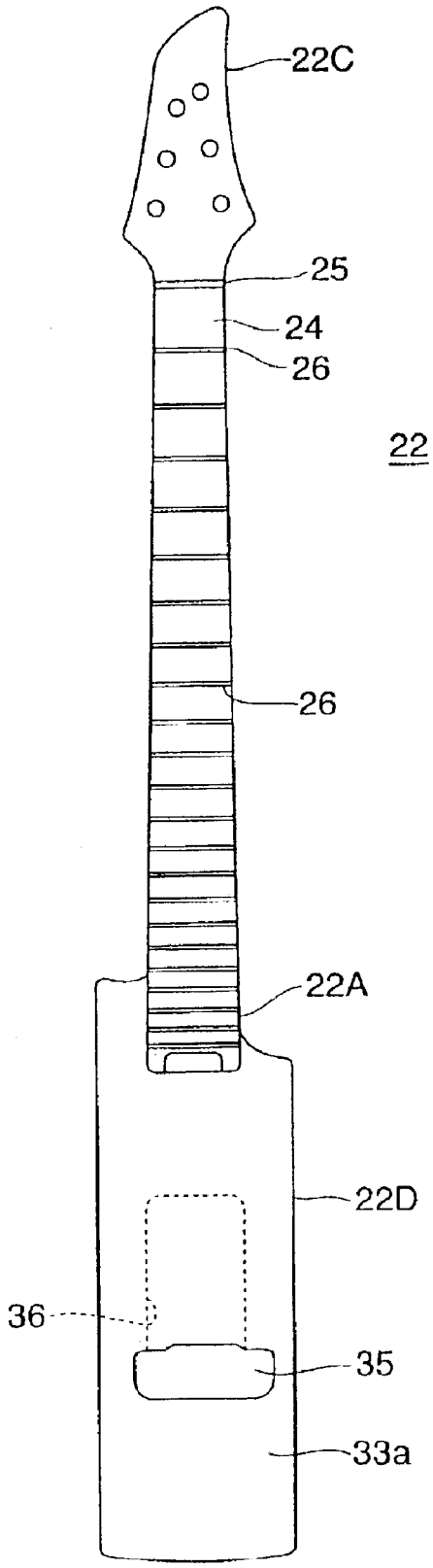
FIG. 7 is a plan view showing a neck of the electric guitar of FIG. 1.
Figure 8:
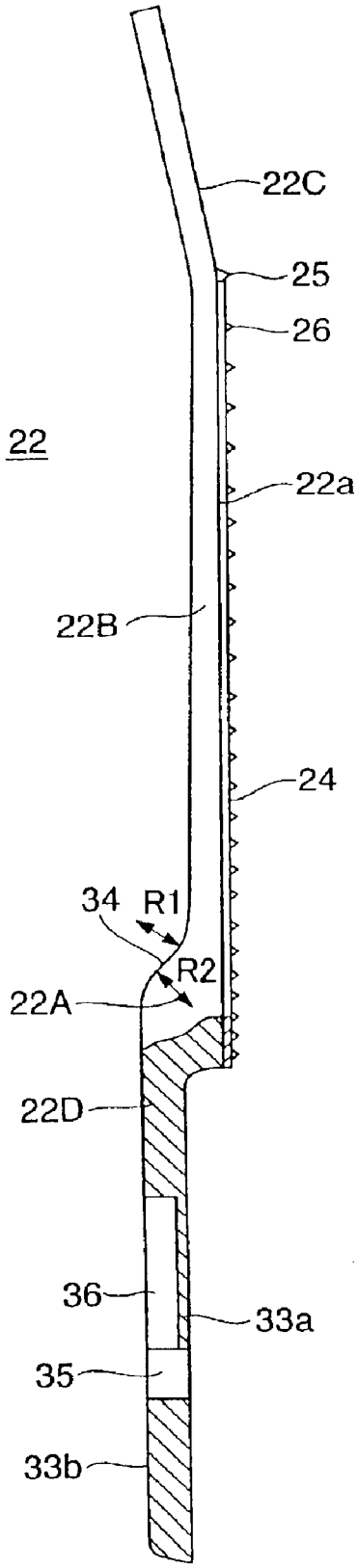
FIG. 8 is a side view partly in cross section showing the neck of the electric guitar of FIG. 1.

FIG. 1 is a plan view showing the exterior appearance of an electric guitar having a body structure in accordance with a preferred embodiment of the invention; FIG. 2 is a side view partly in cross section showing the body structure of the electric guitar of FIG. 1; FIG. 3 is a bottom view of a body of the electric guitar of FIG. 1; FIG. 4 is a plan view of the body; FIG. 5 is a back view of the body; FIG. 6 is an enlarged cross sectional view taken along line VI—VI in FIG. 5; FIG. 7 is a plan view showing a neck; and FIG. 8 is a side view partly in cross section showing the neck.

In FIG. 1, an electric guitar 20 has a body structure similar to the body structure of an electric guitar of a solid type that is conventionally known, wherein it is basically constituted by a body 21 and a neck 22. On a surface 21*a* of the body 21, there are arranged a tremolo mechanism 23 having a bridge 5 for supporting one ends of six strings 4, a pair of pickups 6 for converting vibrations of strings 4 into electric signals, and various controls 8 such as a power switch and dials for adjusting a tone volume and a tone color.

The structure of the body 21 will be described in detail with reference to FIGS. 4 to 6, wherein the exterior of the body 21 having an exterior surface 21*a* and a back 21*b* is basically formed in a prescribed shape corresponding to a typical solid body for an electric guitar. A front end portion 21A of the body 21 has two curved areas, wherein a rectangular hollow 28 to be engaged with a base portion 22A of the neck 22 is formed at the center of a front end surface 27*a*. In addition, three through holes 29A, 29B, and 29C having specific shapes are formed at prescribed positions, which are sequentially arranged in line at approximately the center area of the body 21, to penetrate through the body 21 in a thickness direction from the exterior surface 21*a* to the back 21*b*. Herein, a pair of pickups 6 are respectively embedded in the through holes 29A and 29B, and the bridge 5 is embedded in the through hole 29C, wherein they are fixed to the body 21 by using screws 32.

An engagement hollow (or channel) 30 is formed over the entire length of the back 21*b* of the body 21 (see FIG. 5) at approximately the center area of the body 21. An adhesive bank channel 31 having an appropriate depth and width is formed at the periphery of the bottom of the engagement hollow 30. Specifically, the adhesive bank channel 31 is divided into four sections, namely, channels 31*a* to 31*d*, wherein the channels 31*a* and 31*b* are formed along side walls of the engagement hollow 30 and are arranged in parallel with each other, the channel 31*c* is arranged slightly inward from the front end surface 27*a*, and the channel 31*d* is arranged slightly inward from a rear end surface 27*b*. Both ends of the channel 31*c* are respectively communicated with one ends of the channels 31*a* and 31*b*, while the center portion of the channel 31*c* is broken by the aforementioned rectangular hollow 28. In addition, the other ends of the channels 31*a* and 31*b* are communicated with each other via the channel 31*d*. Furthermore, a hollow space 33 for storing electrical parts (not shown) is formed on the back 21*b* of the body 21 at one side of the engagement hollow 30. After completion of arrangement of electrical parts, the hollow space 33 is closed by a cover (not shown).

Next, the structure of the neck 22 will be described in detail with reference to FIGS. 7 and 8, wherein the neck 22 is constituted by a base portion 22A having a relatively great thickness, a rod portion 22B that is integrally elongated forwards from the base portion 22A, a head 22C that is integrally joined with the tip end of the rod portion 22B, and an extended portion 22D that is integrally extended backwards from the base portion 22A.

The base portion 22A of the neck 22 is engaged with the aforementioned rectangular hollow 28 of the body 21, wherein a fingerboard 24 is joined onto a surface 22*a* of the base portion 22A and the rod 22B. The head 22C has six tuning pegs 9 for stopping the other ends of the six strings 4, one ends of which are supported by the bridge 5 on the body 21. The back of the base portion 22A is curved in an S-shape (i.e., a S-curved face 34) to be continuously connected with the back of the rod portion 22B, wherein edges are chamfered not to join the back and sides to cross each other with right angles therebetween. On the surface of the fingerboard 24, a nut 25 is arranged to support the strings 4 in proximity to the head 22C, and a prescribed number of frets 26 are embedded at prescribed positions.

In the above, the S-curved face 34 is defined by radii R1 and R2 (see FIG. 8), which are determined to improve the smoothness when a player (or a user) slides a hand along the neck 22 in playing of an electric guitar in particular at the aforementioned high position (close to the base portion 22A). That is, in order to maintain a uniform shape of the neck 22 towards the high position as possible, it is necessary to reduce the radius R1 within a range from 30 mm to 70 mm, preferably about 50 mm, for example. In order to improve the smoothness and continuity in the shape of the neck 22, it is necessary to increase the radius R1 within a range from 150 mm to 250 mm, preferably about 200 mm, for example. Incidentally, the other radius R2 may range from 30 mm to 60 mm, for example.

The extending portion 22D of the neck 22 has prescribed dimensions in length and width to substantially match the engagement hollow 30 of the body 21. In addition, the thickness (or height) of the extending portion 22D is slightly greater than the depth of the engagement hollow 30. A surface 33*a* of the extending portion 22D is lower than the surface 22*a* of the base portion 22A and the rod 22B by one step, whereas a back 33*b* of the extending portion 22D substantially matches the back of the base portion 22A. A hole 35 is formed at approximately the center area of the extending portion 22D to penetrate therethrough in a thickness direction from the surface 33*a* to the back 33*b*, wherein it is arranged to match the aforementioned through hole 29C of the body 21 in position. In addition, a hollow space 36 is formed on the back 33*b* of the extending portion 22D in order to allow installation of the bridge 5. The hollow space 36 communicates with the hole 35.

The neck 22 having the aforementioned structure is joined with the body 21 by using adhesive and bolts. In a joining process, adhesive is applied to interior walls of the rectangular hollow 28 as well as the bottom and side walls of the engagement hollow 30 of the body 21. In addition, adhesive is also applied to side surfaces of the base portion 22A as well as the surface 33*a* and side surfaces of the extending portion 22D of the neck 22. Then, the base portion 22A of the neck 22 is engaged with the rectangular hollow 28 of the body 21, and the extending portion 22D of the neck 22 is engaged with the engagement hollow 30 of the body 21, so that the body 21 and the neck 22 are fixed together using adhesive.

In addition, bolts are inserted into holes (not shown) from the back 33*b* of the extending portion 22D of the neck 22 and are screwed into tapped holes of the body 21, so that the extending portion 22D is fixed to the body 21.

Figure 9:
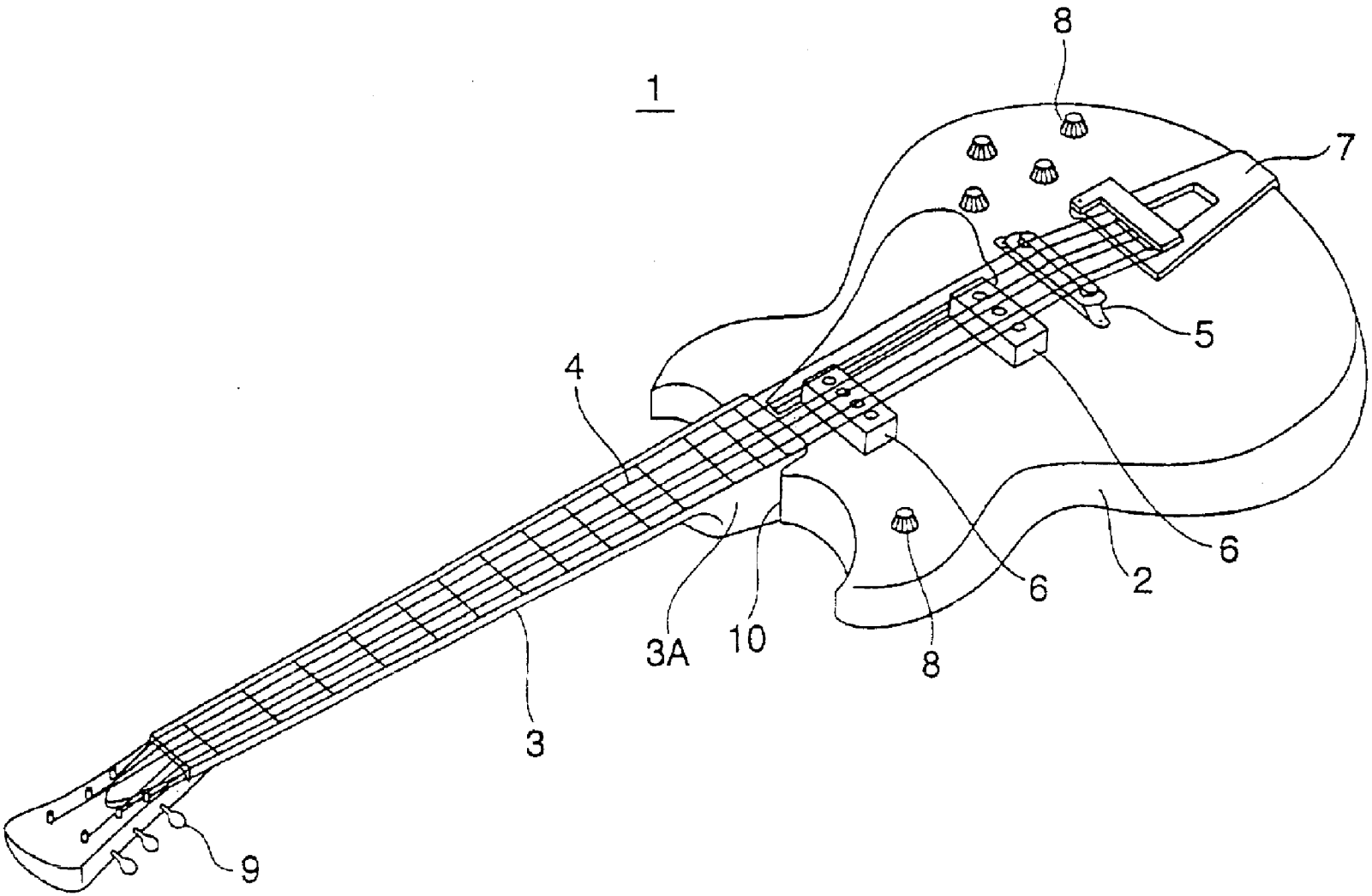
FIG. 9 is a perspective view showing an example of the exterior appearance of an electric guitar that is conventionally known.

As described above, the extending portion 22D that is integrally extended from the base portion 22A of the neck 22 is engaged with the engagement hollow 30 formed on the back 21*b* of the body 21, so that they are fixed together using adhesive and bolts. In the present embodiment compared with the foregoing body structure shown in FIG. 9 in which only the base portion of the neck is joined with the body, it is possible to further increase the contact area between the body and the neck. That is, the present embodiment ensures that the body 21 and the neck 22 can be firmly joined together.

Figure 10:
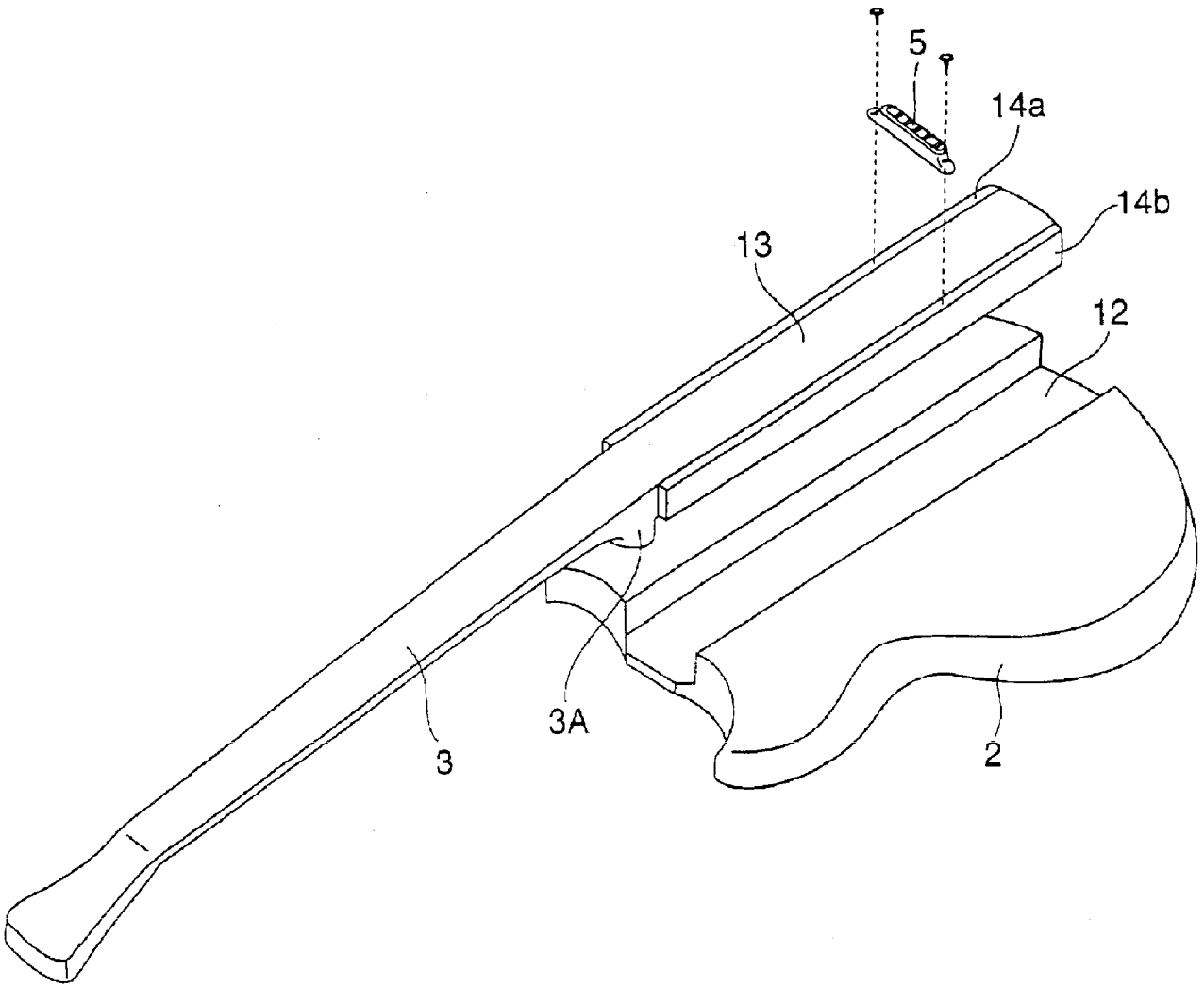
FIG. 10 is an exploded perspective view showing a body structure adapted to the other type of an electric guitar that is conventionally known.

In addition, the present embodiment forms the engagement channel 30 on the back 21*b* of the body 21. Therefore, compared with the foregoing body structure shown in FIG. 10, it is possible to simplify processing and finishing of the exterior surface of the body 21, so that an electric guitar can be manufactured at a relatively low cost.

Furthermore, the adhesive bank channel 31 for banking an excessive of adhesive is formed in the periphery of the engagement channel 30. This guarantees that adhesive will not overflow from the engagement channel 30 to dirty the back 21*b* of the body 21 and the back 33*b* of the extending portion 22D of the neck 22.

Moreover, the S-curved face 34 is formed to smoothly and continuously connect together backs of the base portion 22A and the rod 22B of the neck 22. Hence, even when a player (or a user) holds the base portion 22A of the neck 22 during playing of an electric guitar at the high position, the player does not feel a pain in a hand because the S-curved face 34 does not have angular portions or corners which a player's hand is brought into contact with; therefore, the present embodiment may contribute to an improvement in a player's ability of playing an electric guitar.

In the present embodiment, the body 21 and the neck 22 are firmly joined together using adhesive and bolts, which are not restrictive in this invention. That is, it is possible to fix them together using adhesive only or using bolts only. When the body 21 and the neck 22 are joined together using bolts only, it is unnecessary to form the adhesive bank channel 31 in the periphery of the engagement hollow 30; therefore, it is possible to further simplify the manufacture of the body because of elimination of one step regarding formation of the adhesive bank channel 31.

In summary, the body structure of an electric guitar according to this invention is characterized in that the extending portion 22D of the neck 22 is extended towards the terminal end of the body 21, so that the extending portion 22D may substantially cover the entire length of the back 21*b* of the body 21. This brings outstanding features as follows:

(a) It is possible to enlarge the total contact area between the body 21 and the neck 22, which in turn brings an improvement in the overall strength of an electric guitar.

(b) It is possible to improve sound transmission on an electric guitar, which thus brings an improvement in sound quality.

(c) It is possible to provide engineers with a variety of design choices in designing electric guitars. For example, it is possible to reduce the thickness of a body while increasing the thickness of an extending portion of a neck in an electric guitar. When an extending portion of a neck is not extended towards the terminal end of a body and is stopped in the middle of the back of the body in entire length, a structural step difference may be formed between the body and the extending portion of the neck, which may cause problems in playing an electric guitar. In contrast, this invention ensures that the extending portion of the neck is extended towards the terminal end of the body, wherein no structural step difference is formed in the middle of the back of the body so that no problem may be caused during playing of an electric guitar.

As described heretofore, this invention has a variety of effects and technical features, which will be described below.

(1) The body structure of an electric guitar according to this invention is designed in such a way that an extending portion continuously extended from a base portion of a neck is engaged with an engagement hollow formed on the back of a body, so that the body and the neck are firmly joined together using adhesive and/or bolts.

(2) Even when the body and the neck are joined together, no step differences or gaps are formed on the surface of the body. Therefore, it is possible to omit a finishing process on the surface of the body after a joining process; hence, it is possible to simplify manufacture of an electric guitar. In other words, an electric guitar of this invention requires finishing on the back of the body, which does not require great attention in processing. In addition, it is not necessary to pay great attention to the back of the body even when the body becomes different in color from the neck due to aging deterioration of paint.

(3) In order to cope with a process of joining together the body and the neck using adhesive, an adhesive bank channel is arranged in the periphery of the bottom of the engagement hollow of the body, wherein an excess of adhesive can be reliably prevented from overflowing from the engagement hollow of the body. Thus, it is possible to reliably prevent the back of the body and the back of the extending portion of the neck from being dirtied by an excess of adhesive.

(4) A smoothly curved portion (i.e., an S-curved face) is formed to smoothly and continuously connect together the backs of the base portion and rod of the neck, which does not have angular portions or corners to be brought into contact with a player's hand when a player holds the base portion of the neck in playing of an electric guitar at the high position. Therefore, the player does not feel pain in a hand during playing of an electric guitar at the high position, which may contribute to a further improvement in a player's ability of playing an electric guitar.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A body structure of an electric guitar comprising: a body for arranging a bridge for supporting one ends of strings and at least one pickup for converting vibrations of the strings into electric signals; and a neck having a head in which other ends of the strings are stopped by tuning pegs, wherein an extending portion is integrally extended from a base portion of the neck and is firmly engaged with an engagement hollow that is formed over an entire length of a back of the body, wherein a plurality of through holes are arranged sequentially in a center area of a surface of the body to penetrate through the body in a thickness direction, and wherein the bridge and the pickup are respectively stored and fixed in the through holes of the body using screws.

2. The body structure of an electric guitar according to claim 1, wherein the extending portion of the neck is firmly fixed to the engagement hollow of the body by bolts.

3. The body structure of an electric guitar according to claim 1 further comprising an adhesive bank channel formed in a periphery of a bottom of the engagement channel of the body, so that the extending portion of the neck is firmly fixed to the engagement hollow of the body using adhesive.

4. The body structure of an electric guitar according to claim 1, wherein a smoothly curved surface is formed on or in proximity to a back of the base portion of the neck.

5. The body structure of an electric guitar according to claim 1, wherein a rectangular hollow is formed in a front end portion of the body to engage with the base portion of the neck.

6. The body structure of an electric guitar according to claim 1, wherein a hole is formed in a center area of the extending portion of the neck to communicate with the through hole for storing the bridge.

7. The body structure of an electric guitar according to claim 1, wherein the smoothly curved surface is defined by adequately setting a radius within a prescribed range.

* * * * *